US008706325B2

(12) United States Patent
Friedlander et al.

(10) Patent No.: US 8,706,325 B2
(45) Date of Patent: Apr. 22, 2014

(54) EVALUATING AIRPORT RUNWAY CONDITIONS IN REAL TIME

(75) Inventors: Robert R. Friedlander, Southbury, CT (US); James R. Kraemer, Santa Fe, NM (US)

(73) Assignee: International Business Machines Corporation, Armonk, NY (US)

( * ) Notice: Subject to any disclaimer, the term of this patent is extended or adjusted under 35 U.S.C. 154(b) by 435 days.

(21) Appl. No.: 13/191,968

(22) Filed: Jul. 27, 2011

(65) Prior Publication Data

US 2013/0030613 A1 Jan. 31, 2013

(51) Int. Cl.
*G08G 5/02* (2006.01)

(52) U.S. Cl.
CPC ..... *G08G 5/02* (2013.01)
USPC ..... 701/16; 73/146

(58) Field of Classification Search
USPC ..... 701/16
See application file for complete search history.

(56) References Cited

U.S. PATENT DOCUMENTS

| | | | | |
|---|---|---|---|---|
| 3,820,381 | A | | 6/1974 | Thurston |
| 3,838,421 | A | * | 9/1974 | Dasse-Hartaut et al. ..... 342/52 |
| 4,073,183 | A | | 2/1978 | Byalko et al. |
| 4,186,590 | A | | 2/1980 | Egorov et al. |
| 4,511,247 | A | * | 4/1985 | McGovern et al. ..... 356/3 |
| 4,530,233 | A | | 7/1985 | Kadi |
| 5,195,046 | A | | 3/1993 | Gerardi et al. |
| 5,549,803 | A | | 8/1996 | Schoess et al. |
| 5,681,986 | A | | 10/1997 | Merk et al. |
| 5,736,940 | A | | 4/1998 | Burgener |
| 6,260,004 | B1 | | 7/2001 | Hays et al. |
| 6,265,979 | B1 | | 7/2001 | Chen et al. |
| 6,718,270 | B2 | | 4/2004 | Horiuchi et al. |
| 6,950,767 | B2 | | 9/2005 | Yamashita et al. |
| 7,228,740 | B2 | | 6/2007 | Sinha |
| 7,325,759 | B2 | | 2/2008 | Meyer |
| 7,343,136 | B2 | | 3/2008 | Liu et al. |
| 7,535,355 | B2 | | 5/2009 | Barone |
| 7,627,441 | B2 | | 12/2009 | Longsdorf et al. |
| 7,630,948 | B2 | | 12/2009 | Friedlander et al. |
| 7,693,663 | B2 | | 4/2010 | Friedlander et al. |

(Continued)

FOREIGN PATENT DOCUMENTS

| | | |
|---|---|---|
| JP | 52104960 A | 9/1977 |
| JP | 4235380 A | 8/1992 |

(Continued)

OTHER PUBLICATIONS

United Kingdom Patent Application No. GB1216790.4, Combined Search and Examination Report, Jan. 18, 2013, pp. 1-5.

(Continued)

*Primary Examiner* — Shelly Chen
(74) *Attorney, Agent, or Firm* — John R. Pivnichny; Law Office of Jim Boice

(57) ABSTRACT

A computer-implemented method, system, and/or computer program product evaluates a real-time condition of a construct of an airport runway. A processor receives a set of temporally-spaced runway vibrations. This set of temporally-spaced runway vibrations is measured by a set of smart sensors on an airport runway after a landing aircraft touches down on the airport runway. Using data that describes the set of temporally-spaced runway vibrations as inputs to an analysis algorithm, a real-time physical condition of a construct of the airport runway is determined.

20 Claims, 7 Drawing Sheets

(56) References Cited

U.S. PATENT DOCUMENTS

| | | | | |
|---|---|---|---|---|
| 7,720,574 | B1 | 5/2010 | Roys | |
| 7,762,142 | B2 | 7/2010 | Rakow et al. | |
| 8,154,723 | B2 | 4/2012 | Fu et al. | |
| 8,538,667 | B2 | 9/2013 | Friedlander et al. | |
| 2004/0122787 | A1 | 6/2004 | Avinash et al. | |
| 2005/0011278 | A1 | 1/2005 | Brown et al. | |
| 2005/0256885 | A1 | 11/2005 | Yairi et al. | |
| 2006/0071786 | A1 | 4/2006 | Fano | |
| 2006/0097983 | A1 | 5/2006 | Haggman et al. | |
| 2006/0285350 | A1* | 12/2006 | Wang | 362/555 |
| 2007/0050121 | A1 | 3/2007 | Ammon et al. | |
| 2007/0199382 | A1 | 8/2007 | Sakai | |
| 2008/0009099 | A1 | 1/2008 | Kishkovich et al. | |
| 2008/0077463 | A1 | 3/2008 | Friedlander et al. | |
| 2008/0180281 | A1 | 7/2008 | Bilimoria et al. | |
| 2008/0270034 | A1 | 10/2008 | Friedlander et al. | |
| 2008/0274553 | A1 | 11/2008 | Bratton et al. | |
| 2009/0157302 | A1 | 6/2009 | Tashev et al. | |
| 2009/0271100 | A1 | 10/2009 | Kim et al. | |
| 2010/0268469 | A1 | 10/2010 | Harrison et al. | |
| 2011/0085156 | A1 | 4/2011 | Jones et al. | |
| 2011/0153208 | A1 | 6/2011 | Kruglick | |
| 2011/0173067 | A1 | 7/2011 | Herbst et al. | |
| 2011/0308638 | A1 | 12/2011 | Hyland et al. | |
| 2013/0030680 | A1 | 1/2013 | Friedlander et al. | |
| 2013/0030724 | A1 | 1/2013 | Friedlander et al. | |
| 2013/0030725 | A1 | 1/2013 | Friedlander et al. | |
| 2013/0040399 | A1 | 2/2013 | Belbruno et al. | |

FOREIGN PATENT DOCUMENTS

| | | | | | |
|---|---|---|---|---|---|
| JP | 05052972 | U | | 7/1993 | |
| JP | 07044117 | A | * | 2/1995 | G09F 13/20 |
| JP | 08085496 | A | * | 4/1996 | B64F 1/36 |
| JP | 2006194795 | A | | 7/2006 | |
| JP | 2007531868 | A | | 11/2007 | |
| WO | 2008052786 | A1 | | 5/2008 | |
| WO | 2010071607 | A1 | | 6/2010 | |

OTHER PUBLICATIONS

International Searching Authority, International Search Report and Written Opinion, Dec. 18, 2012, pp. 1-6.

N. Harrington, "Knock-Based Commands for Your Linux Laptop", pp. 1-11, Jul. 25, 2006, http://www.ibm.com/developerworks/library/l-knockage/index.html.

W. Xie et al., "A New Diagnostic Method of Bolt Loosening Detection for Thermal Protection Systems", Proceedings of the SPIE—The International Society for Optical Engineering, vol. 7493, 2009.

S. Lihua et al., "Applications of Piezoelectric Material Sensors in Smart Structures", Transactions of Nanjing University of Aeronautics & Astronautics, vol. 1, No. 2, 210-213, Dec. 1996.

J. Schoess et al., "Smart Aircraft Fastener Evaluation (SAFE) System—A Condition-Based Corrosion Detection System for Aging Aircraft", Proceedings of the SPIE—The International Society for Optical Engineering, vol. 2718, 175-184, 1996.

J. Schoess et al., "Smart Fastener for KC-135 Structural Integrity Monitoring", Proceedings of the SPIE—The International Society for Optical Engineering, vol. 3042, pp. 278-282, 1997.

T. Bojko, "Smart Sensor Solutions for Mechanical Measurements and Diagnostics", Metrology and Measurement Systems, vol. 12, No. 1, 2005, pp. 95-103.

S. Kessler, "Piezoelectric-Based In-Situ Damage Detection of Composite Materials for Structural Health Monitoring Systems", Doctorate of Philosophy in Aeronautics and Astronautics at The Massachusetts Institute of Technology, 2002, pp. 1-200.

D. Sinha, "Acoustic Sensor for Pipeline Monitoring: Technology Report", Los Alamos National Laboratory, Jul. 20, 2005, pp. 1-23.

B. Umeadi et al., "The Development of an Intelligent Sensor for the Monitoring of Pipeline System Integrity", Oil and Gas 2008, pp. 1-4.

C. Zang et al., "Structural Health Monitoring and Damage Assessment Using Frequency Response Correlation Criteria", Journal of Engineering Mechanics, Sep. 2007, 981-993.

S.L. Hung et al., "Aiming for the Top University Plan: Preliminary Results" 2009, http://www.cv.nctu.edu.tw/~wwwadm/chinese/monitoring2/result.html.

U.S. Appl. No. 11/741,186, filed Apr. 27, 2007, Friedlander, et al.: Prosecution History.

R. Marinelli, "FAA Runway Friction Program", Runway Condition Determination, Reporting, and Report Dissemination Workshop, Jun. 20, 2006, pp. 1-13.

T. Yager, "Runway Friction Measurement", FAA/Aviation Industry Workshop on Runway Condition Determination, Reporting, and Report Dissemination, Aug. 7-8, 2006, pp. 1-15.

Douglas Equipment International Inc., Special Products Division "MU-Meter MK 6—Specification" PDF Retrieved From http://www.douglas-equipment.com/product_display.php?id=0000000035, pp. 1-2.

U.S. Appl. No. 13/192,887—Non-Final Office Action Mailed Feb. 7, 2013.

U.S. Appl. No. 13/252,342—Specification Filed Oct. 4, 2011.

U.S. Appl. No. 13/252,342—Non-Final Office Action Mailed Nov. 9, 2012.

U.S. Appl. No. 13/962,665—Non-Final Office Action Mailed Sep. 27, 2013.

U.S. Appl. No. 13/192,149—Non-Final Office Action Mailed Sep. 27, 2013.

U.S. Appl. No. 13/190,172—Non-Final Office Action Mailed Sep. 25, 2013.

* cited by examiner

EVALUATING AIRPORT RUNWAY CONDITIONS IN REAL TIME

BACKGROUND

The present disclosure relates to the field of electronics, and specifically to electronic devices used to measure vibration. Still more particularly, the present disclosure relates to electronic sensors used to evaluate the physical condition of an airport runway.

Vibration detection devices are used to detect and transpose mechanical vibration energy into analogous electrical signals that represent the detected mechanical vibration energy. A vibration detection device uses a motion sensitive component, such as an accelerometer, a piezoelectric device (e.g., a tuned crystal), etc. to make these mechanical-to-electrical transformations.

SUMMARY

In one embodiment of the present disclosure, a computer-implemented method evaluates a real-time condition of a construct of an airport runway. A processor receives a set of temporally-spaced runway vibrations. This set of temporally-spaced runway vibrations is measured by a set of smart sensors on an airport runway after a landing aircraft touches down on the airport runway. Using data that describes the set of temporally-spaced runway vibrations as inputs to an analysis algorithm, a real-time physical condition of a construct of the airport runway is determined.

In one embodiment of the present disclosure, a computer program product evaluates a real-time condition of a construct of an airport runway. First program instructions receive a set of temporally-spaced runway vibrations. This set of temporally-spaced runway vibrations is measured by a set of smart sensors on an airport runway as a landing aircraft applies its brakes after touching down on the airport runway. Second program instructions input data that describes the set of temporally-spaced runway vibrations into an analysis algorithm, in order to determine a real-time physical condition of a construct of the airport runway. The first and second program instructions are stored on a computer readable storage media.

In one embodiment of the present disclosure, a system, which includes a processor, a computer readable memory, and a computer readable storage media, evaluates a real-time condition of a construct of an airport runway. First program instructions receive a set of temporally-spaced runway vibrations. This set of temporally-spaced runway vibrations is measured by a set of smart sensors on an airport runway as a landing aircraft applies its brakes after touching down on the airport runway. Second program instructions input data that describes the set of temporally-spaced runway vibrations into an analysis algorithm, in order to determine a real-time physical condition of a construct of the airport runway. The first and second program instructions are stored on a computer readable storage media for execution by the processor via the computer readable memory.

DETAILED DESCRIPTION

Figure 1:
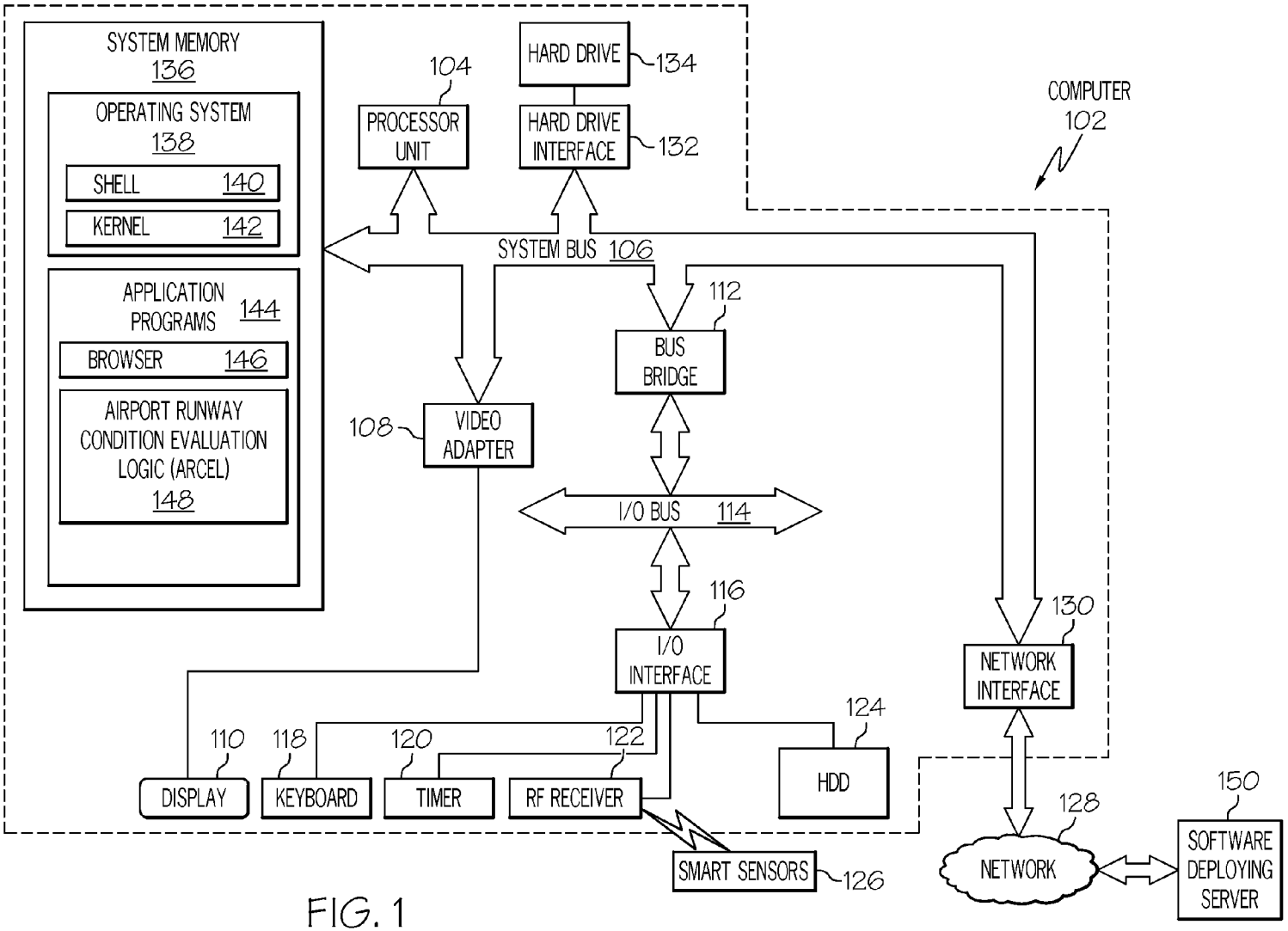
FIG. 1 depicts an exemplary computer which may be utilized by the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

With reference now to the figures, and in particular to FIG. 1, there is depicted a block diagram of an exemplary computer 102, which the present invention may utilize. Note that some or all of the exemplary architecture shown for computer 102 may be utilized by software deploying server 150.

Computer 102 includes a processor unit 104, which may utilize one or more processors each having one or more processor cores, that is coupled to a system bus 106. A video adapter 108, which drives/supports a display 110, is also coupled to system bus 106. System bus 106 is coupled via a bus bridge 112 to an Input/Output (I/O) bus 114. An I/O interface 116 is coupled to I/O bus 114. I/O interface 116 affords communication with various I/O devices, including a keyboard 118, a timer 120, a Radio Frequency (RF) receiver 122, a Hard Disk Drive (HDD) 124, and smart sensors 126, which communicate wirelessly with the RF receiver 122. Examples of smart sensors 126 include, but are not limited to, smart sensors 204*a-n* shown below in FIG. 2, smart sensors 304*a-e* depicted in FIG. 3, and/or RFID-enabled smart sensor 406 depicted in FIG. 4. Note that, in one embodiment, elements 122 and 126 are hardwired together, such that readings from the sensors (e.g., element 126) are able to be transmitted via wiring to a receiver (e.g., element 122). Note also that the format of the ports connected to I/O interface 116 may be any known to those skilled in the art of computer architecture, including but not limited to Universal Serial Bus (USB) ports.

Computer 102 is able to communicate with a software deploying server 150 via a network 128 using a network interface 130, which is coupled to system bus 106. Network 128 may be an external network such as the Internet, or an internal network such as an Ethernet or a Virtual Private Network (VPN).

A hard drive interface 132 is also coupled to system bus 106. Hard drive interface 132 interfaces with a hard drive 134. In a preferred embodiment, hard drive 134 populates a system memory 136, which is also coupled to system bus 106. System memory is defined as a lowest level of volatile memory in computer 102. This volatile memory includes additional higher levels of volatile memory (not shown), including, but not limited to, cache memory, registers and buffers. Data that populates system memory 136 includes computer 102's operating system (OS) 138 and application programs 144.

OS 138 includes a shell 140, for providing transparent user access to resources such as application programs 144. Generally, shell 140 is a program that provides an interpreter and an interface between the user and the operating system. More specifically, shell 140 executes commands that are entered into a command line user interface or from a file. Thus, shell 140, also called a command processor, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 142) for processing. Note that while shell 140 is a text-based, line-oriented user interface, the present invention will equally well support other user interface modes, such as graphical, voice, gestural, etc.

As depicted, OS 138 also includes kernel 142, which includes lower levels of functionality for OS 138, including providing essential services required by other parts of OS 138 and application programs 144, including memory management, process and task management, disk management, and mouse and keyboard management.

Application programs 144 include a renderer, shown in exemplary manner as a browser 146. Browser 146 includes program modules and instructions enabling a World Wide Web (WWW) client (i.e., computer 102) to send and receive network messages to the Internet using HyperText Transfer Protocol (HTTP) messaging, thus enabling communication with software deploying server 150 and other described computer systems.

Application programs 144 in computer 102's system memory (as well as software deploying server 150's system memory) also include an Airport Runway Condition Evaluation Logic (ARCEL) 148. ARCEL 148 includes code for implementing the processes described below, and particularly as described in reference to FIGS. 2-9. In one embodiment, computer 102 is able to download ARCEL 148 from software deploying server 150, including in an on-demand basis. Note further that, in one embodiment of the present invention, software deploying server 150 performs all of the functions associated with the present invention (including execution of ARCEL 148), thus freeing computer 102 from having to use its own internal computing resources to execute ARCEL 148.

The hardware elements depicted in computer 102 are not intended to be exhaustive, but rather are representative to highlight essential components required by the present invention. For instance, computer 102 may include alternate memory storage devices such as magnetic cassettes, Digital Versatile Disks (DVDs), Bernoulli cartridges, and the like. These and other variations are intended to be within the spirit and scope of the present invention.

Figure 2:
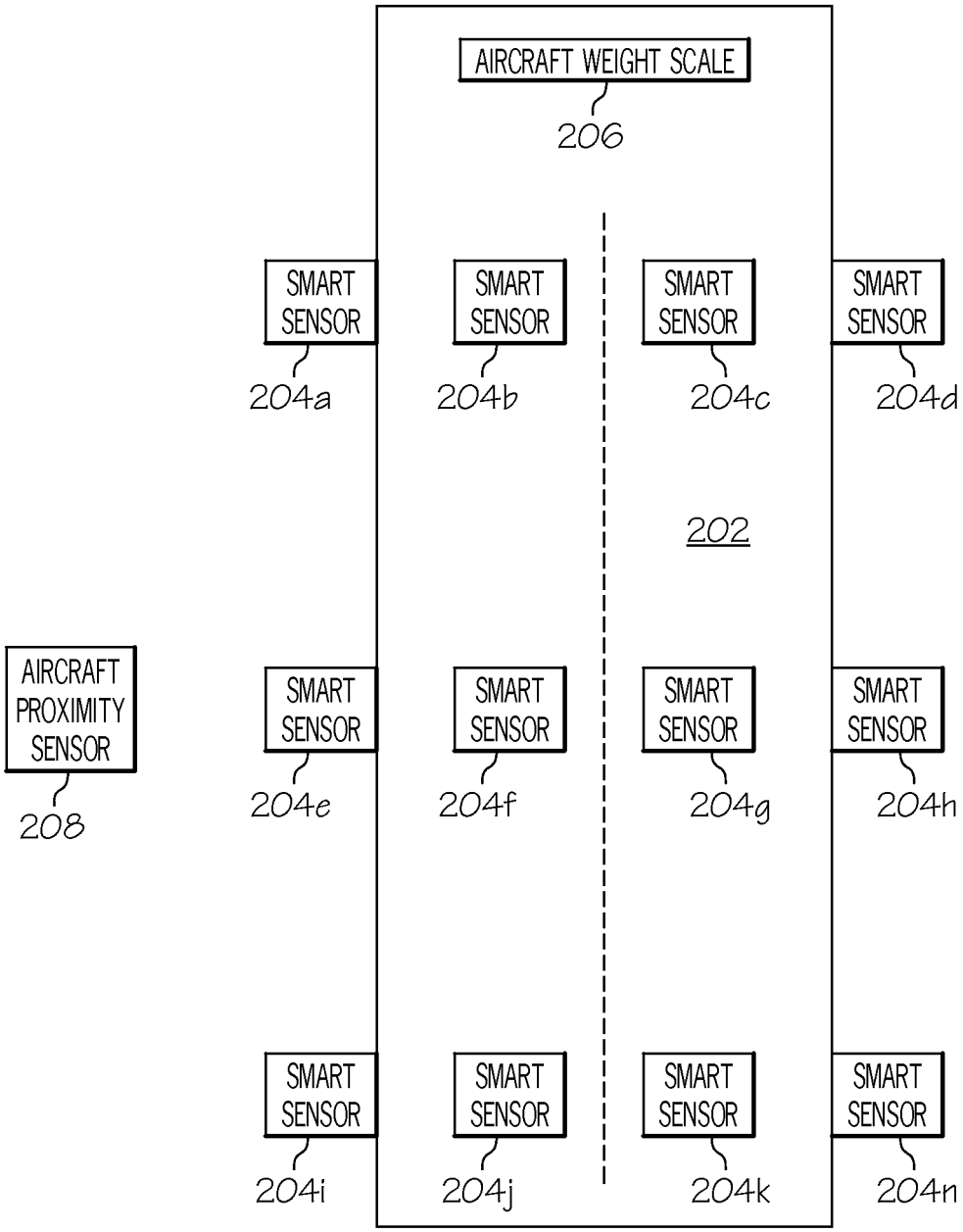
FIG. 2 illustrates an exemplary airport runway to which smart sensors are coupled.

With reference now to FIG. 2, an exemplary airport runway 202, whose construct is evaluated in real-time in accordance with the present disclosure, is presented. As used herein, the term "construct" is defined as the arrangements of components used in the construction of the airport runway 202. That is, the condition of the construct of the airport runway describes the physical condition of components used to build the airport runway, such as concrete, rebar, top coating, paint, etc., and does not include extraneous matter such as wind-blown dirt, ice, rain water, etc. that may have reached the surface of the airport runway after it was constructed.

As depicted in FIG. 2, the airport runway 202 is equipped with multiple smart sensors 204*a-n*, where "n" is an integer. As depicted in FIG. 2, smart sensors may be affixed to the side of the airport runway 202 (e.g., smart sensors 204*a*, 204*d*, 204*e*, 204*h*, 204*i*, and 204*n*); they may be embedded into the top of the airport runway 202 (e.g., smart sensors 204*b*, 204*g*, and 204*j*); and/or they may be embedded within or below the airport runway 202 (e.g., smart sensors 204*c*, 204*f*, and 204*k*). Each smart sensor includes a sensor that transduces mechanical vibration of the construct of the airport runway 202 into an analog vibration pattern, which can then be digitized using a Fast Fourier Transform (FFT) algorithm, which determines a set of underlying frequency components of the mechanical vibration patterns. These frequency components are then digitized for storage and use in rapid future comparison operations.

In one embodiment of the present invention, the airport runway 202 also includes an embedded aircraft weight scale 206, which includes sensors (e.g., strain gauges) that measure the weight of an aircraft as it rolls over the aircraft weight scale 206. These weight measurements are transmitted by a transmitter (not shown) that is associated with or is part of the aircraft weight scale 206 to a receiver (e.g., RF receiver 122 shown in FIG. 1, either wirelessly or via a hard wire).

In one embodiment of the present invention, an aircraft proximity sensor 208 is positioned near the airport runway 202. The aircraft proximity sensor 208 detects the presence of an aircraft as it is landing or taking off from the airport runway 202 using motion sensors, heat sensors, light sensors, etc. (not shown). Furthermore, aircraft proximity sensor 208 includes, or is associated with, logic (which may be local—not shown, or may be part of ARCEL 148 described in FIG. 1) that calculates the rate of descent and/or rate of ascent of aircraft that are landing or taking off (respectively).

Figure 3:
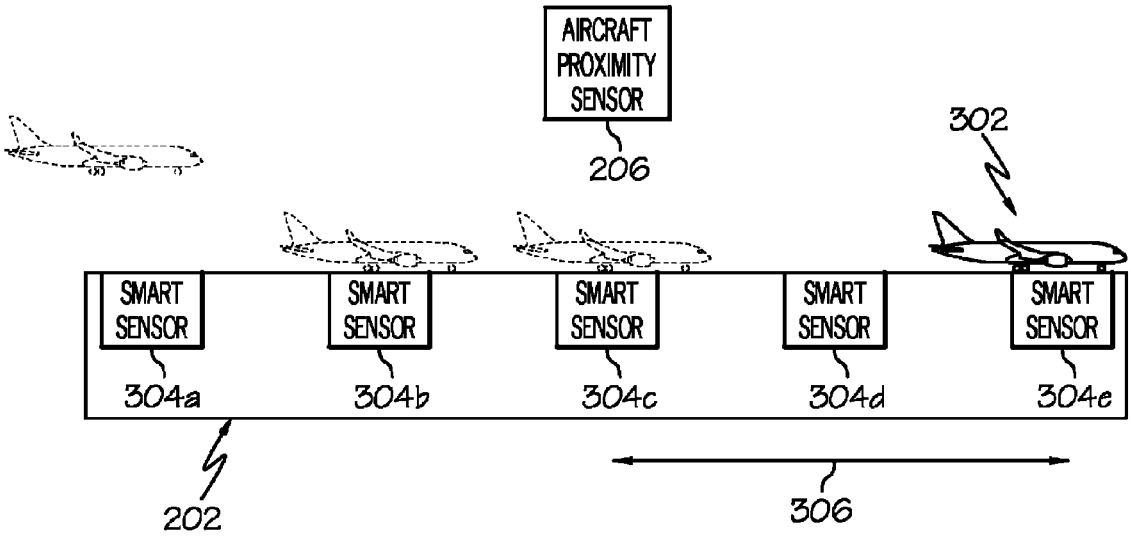
FIG. 3 depicts an aircraft landing on the airport runway shown in FIG. 2.

With reference now to FIG. 3, a side view of the aircraft runway 202 of FIG. 2 is illustrated. Smart sensors 304*a-e* are analogous to the smart sensors 204*a-n* depicted in FIG. 2. Note that an aircraft 302 is depicted as landing on the airport runway 202. The aircraft proximity sensor 208 is able to detect where on the airport runway 202 that the aircraft 302 touched down, as well as aircraft 302's rate of descent when it impacted (touched down) on the airport runway 202.

In the illustration of FIG. 3, the aircraft 302 touched down at the location of smart sensor 304*b*. The pilot of aircraft 302 then applied the brakes of aircraft 302 where smart sensor 304*c* is located, and continued to brake until aircraft 302 reached smart sensor 304*e*. As described herein, vibrations measured by the smart sensors 304*a-e* are used to evaluate a real-time condition of a construct of airport runway 202. More specifically, a processor (e.g., processor unit 104 shown in FIG. 1) initially receives a set of temporally-spaced runway vibrations. These temporally-spaced runway vibrations are measurements that are taken over a sequential period of time (e.g., every second for ten seconds) by the set of smart sensors 304*a-e*. The measurements are taken as the landing aircraft 302 applies its brakes after touching down on the airport runway (e.g., while traveling along the airport runway 202 from the location of the smart sensor 304*c* to the location of the smart sensor 304*e*).

Data that describes this set of temporally-spaced runway vibrations (e.g., FFT-generated digital information) is used as inputs to an analysis algorithm being executed by a processor, in order to determine a real-time physical condition of the construct of the airport runway 302. That is, the vibration data is "recognized" by the analysis algorithm as being indicative of a range of construct conditions, including top coat erosion, concrete cracks, runway shifting, chipping, concrete breakage/sloughing, etc. In one embodiment, the analysis algorithm simply compares the set of temporally-spaced runway vibrations to a known series of temporally-spaced runway vibrations. This known series of temporally-spaced runway vibrations was generated and recorded when the real-time physical condition of the airport runway previously existed at the airport runway, either under real life conditions or under simulation (of the airport runway, the environment, and/or the conditions of the construct.

Again, note the presence of the aircraft proximity sensor 208, which is able to determine both the physical location, as well as the speed and rate of descent, of the aircraft 302 as it touches down on the airport runway 202.

Figure 4:
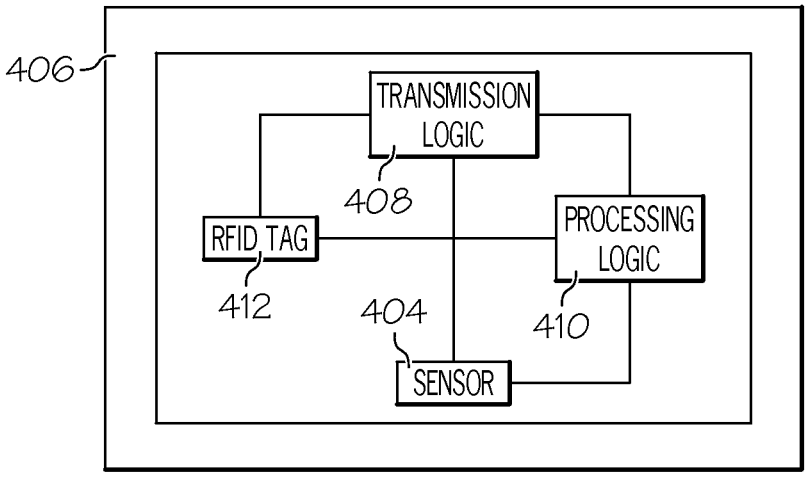
FIG. 4 illustrates an exemplary RFID enabled smart sensor that is coupled to the airport runway shown in FIGS. 2-3.

Additional detail of an exemplary smart sensor, such as the smart sensors 204*a-n* depicted in FIG. 2 and/or the smart sensors 304*a-e* depicted in FIG. 3, is illustrated in FIG. 4 as an RFID-enabled smart sensor 406. Within the RFID-enabled smart sensor 406 is a sensor 404. Sensor 404 is able to sense mechanical vibration (i.e., vibrations that are propagated through a solid medium such as the metal and concrete that make up the airport runway 202 illustrated in FIGS. 2-3). In one embodiment, sensor 404 is also able to detect acoustic vibration, such as sound that propagates through air from the landing aircraft.

In one embodiment, sensor 404 is directly coupled to a transmission logic 408, which is able to transmit the raw information detected by the sensor 404 to a receiver (e.g., RF receiver 122 shown in FIG. 1). For example, assume that sensor 404 detects mechanical vibrations through the use of an internal crystal-based strain gauge and/or accelerometer. The sensor 404 transduces these mechanical vibrations into electrical analog signals, which is directly transmitted by the transmission logic 408. In another embodiment, however, the transduced mechanical vibrations are first sent to a local processing logic 410 within the RFID-enabled smart sensor 406. This processing logic 410 is able to quantify and digitize the transduced mechanical vibrations before they are sent to the transmission logic 408.

Note that in one embodiment, an RFID tag 412 is also a component of the RFID-enabled smart sensor 406. The RFID tag 412, which is different/unique to each RFID-enabled smart sensor 406, identifies where on the airport runway 202 a particular RFID-enabled smart sensor 406 is affixed. The RFID tags may be active (i.e., battery powered), semi-passive (i.e., powered by a battery and a capacitor that is charged by an RF interrogation signal), or purely passive (i.e., either have a capacitor that is charged by an RF interrogation signal or are geometrically shaped to reflect back specific portions of the RF interrogation signal). These passive RFID tags may contain an on-board Integrated Circuit (IC) chip, or they may be chipless.

Figure 5:
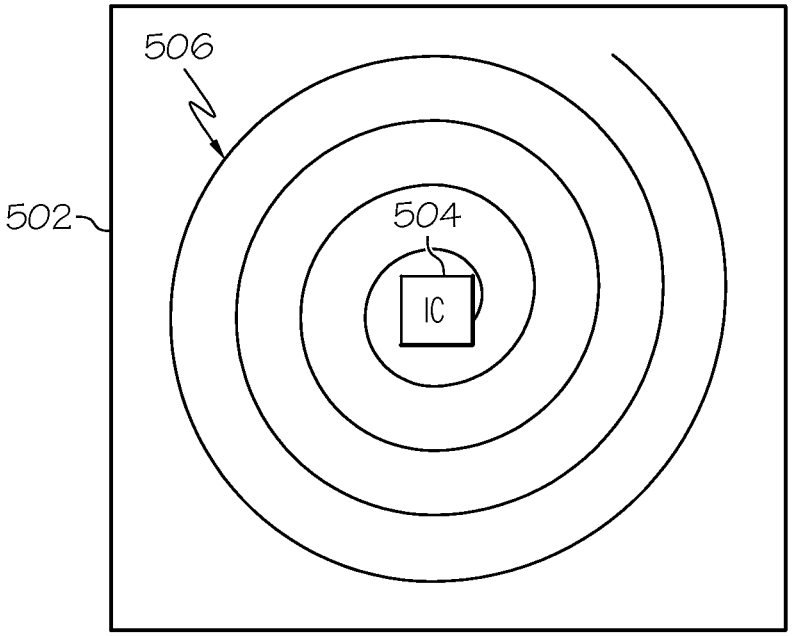
FIG. 5 depicts an exemplary RFID tag that may be used by the present invention.
Figure 6:
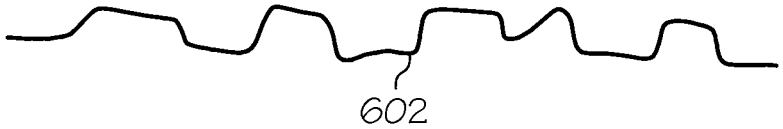
FIG. 6 illustrates an exemplary chipless RFID tag that may be used by the present invention.

With reference now to FIGS. 5-6, exemplary RFID tags are depicted. More specifically, FIG. 5 depicts an exemplary chip-enabled RFID tag 502, which is a passive RFID tag that has an on-board IC chip 504 and a coupled antenna 506. The IC chip 504 stores and processes information, including information that describes the location at which the chip-enabled RFID tag 502 is affixed to the airport runway 202.

The IC chip 504 may contain a low-power source (e.g., a capacitor, not shown, that is charged by an interrogation signal received by the coupled antenna 506). Upon the capacitor being charged, the RFID tag 502 then generates a radio signal, which includes the sensor location information stored in the IC chip 504, to be broadcast by the coupled antenna 506.

FIG. 6 illustrates an exemplary chipless RFID tag 602. As the name implies, chipless RFID tag 602 does not have an IC chip, but is only an antenna that is shaped to reflect back a portion of an interrogation signal. That is, the chipless RFID tag 602 (also known as a Radio Frequency (RF) fiber) is physically shaped to reflect back select portions of a radio interrogation signal from an RF transmission source. Chipless RFID tag 602 typically has a much shorter range than that of chip-enabled RFID tag 502. Furthermore, the amount of information that chipless RFID tag 602 can return is much smaller than that of chip-enabled RFID tag 502, which is able to store relatively large amounts of data in the on-board IC chip 504.

Figure 7:
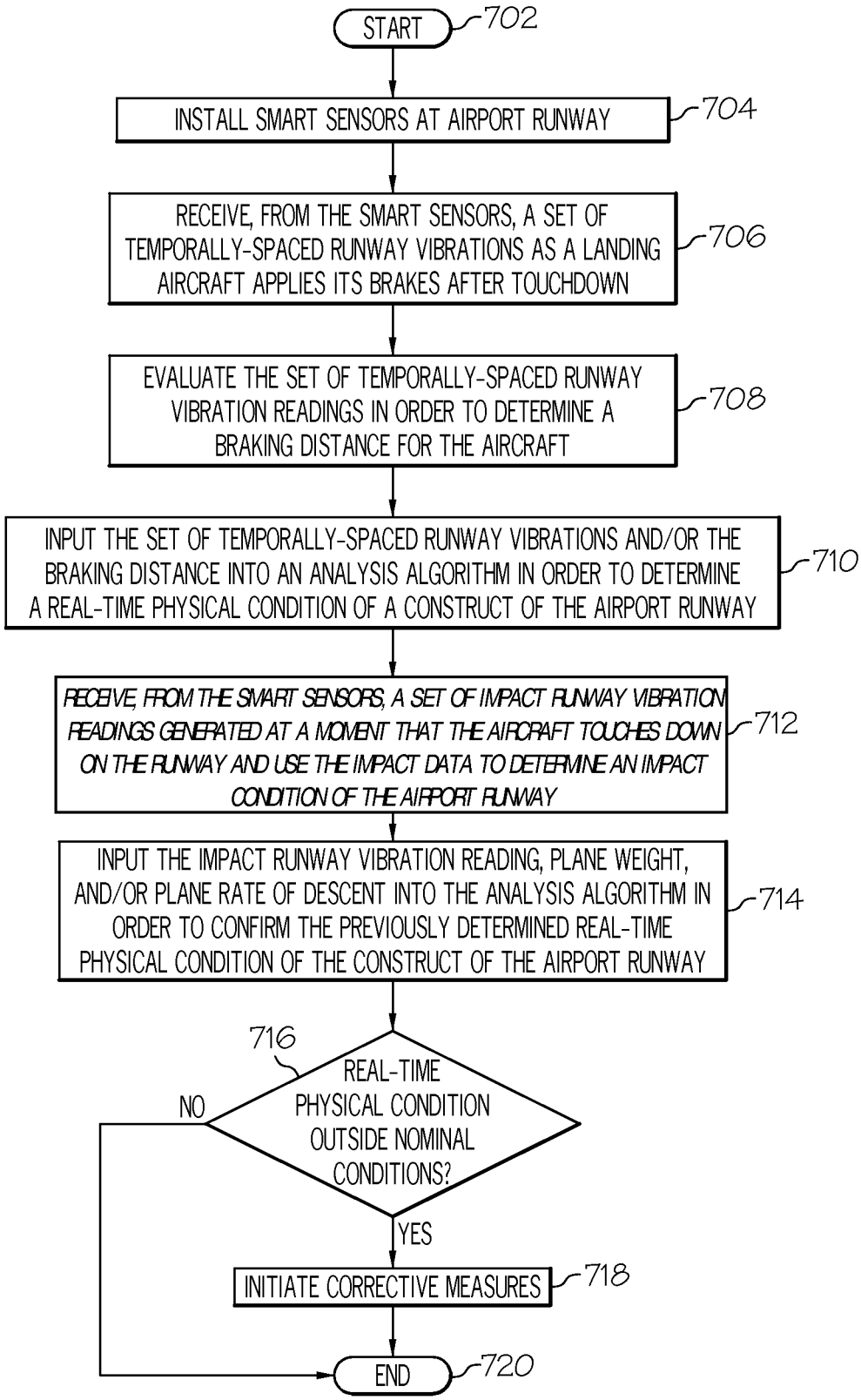
FIG. 7 is a high level flow chart of one or more steps performed by a processor to evaluate a real-time condition of an airport runway.
Figure 8:
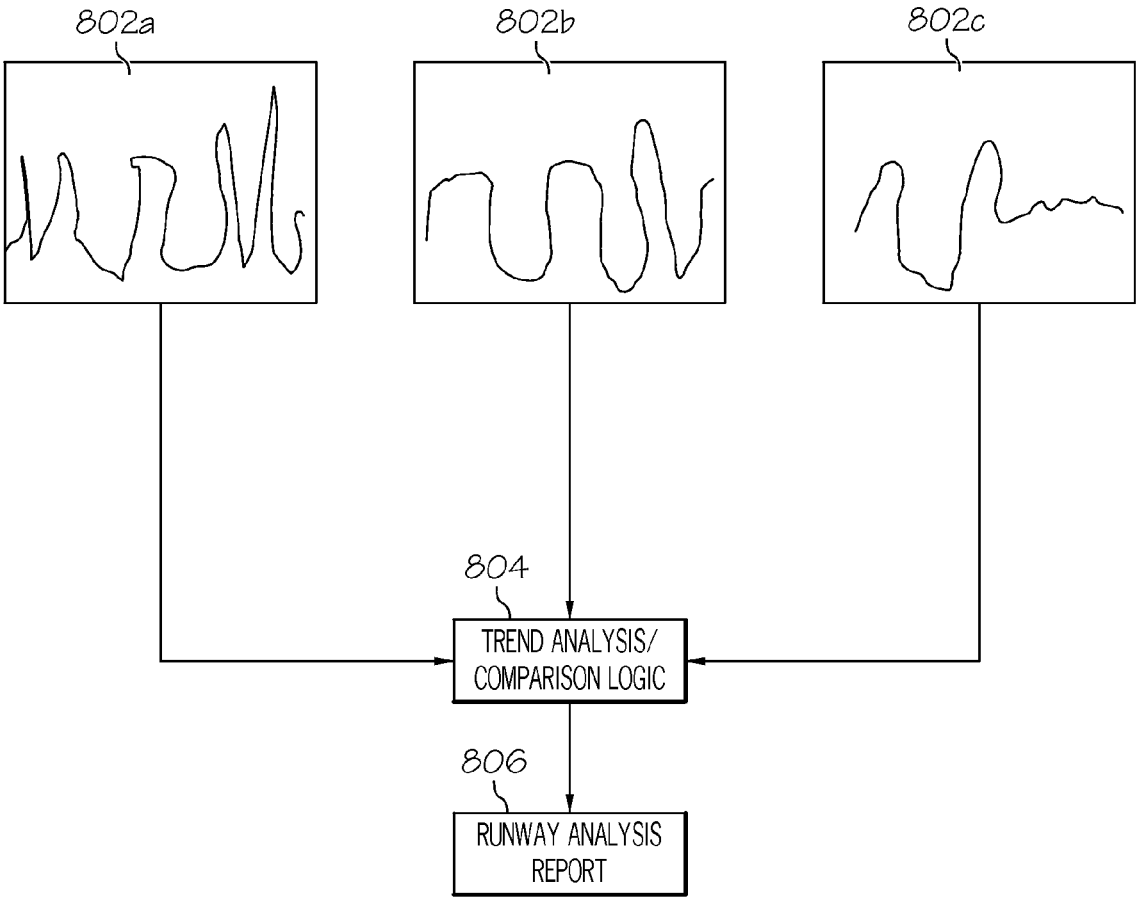
FIG. 8 depicts an exemplary set temporally-spaced frequency (F) plus amplitude (A) vibration patterns, from uniquely-identified smart sensors coupled to the airport runway shown in FIG. 2, which is evaluated to determine a real-time condition of a construct of an airport runway.

With reference now to FIG. 7, a high level flow chart of one or more steps performed by a processor to evaluate a real-time condition of an airport runway is presented. After initiator block 702, a set of smart sensors is installed on, below, and/or adjacent to an airport runway (block 704). These smart sensors are capable of transducing vibration energy from the airport runway into an analog pattern of these vibrations. That is, the smart sensors detect and transduce mechanical vibrations of the airport runway to generate a frequency (F) and amplitude (A) vibration pattern, which can be digitized (e.g., through the use of a Fast Fourier Transform (FFT) algorithm) for storage and/or transmission to a remote computer.

As described in block 706, a set of temporally-spaced runway vibrations are generated by the smart sensors as a landing aircraft applies its brakes after touching down on the airport runway. This set of temporally-spaced runway vibrations are then sent to a computer, such as computer 102 shown in FIG. 1. As shown in block 708, this set of temporally-spaced runway vibrations can be evaluated in order to determine a braking distance for the aircraft. That is, as discussed in FIG. 3 above, the smart sensors are able to recognize the unique vibration pattern that is indicative of the pilot applying the brakes of the aircraft after touching down. The unique vibration pattern caused by the application of the brakes is a result of the change in the interface between the tires of the aircraft and the surface of the runway. Whereas previously the tires rolled freely, producing an identifiable vibration pattern, the resistance as the wheels forcibly slow against the runway introduces a new dynamic of skipping, chatter, or even micro-chatter, indicating that the brakes are being applied and causing a unique vibration pattern to occur.

As described in block 710, the set of temporally-spaced runway vibrations are then used as inputs into an analysis algorithm (e.g., ARCEL 148 shown in FIG. 1) in order to determine a real-time physical condition of the construct (e.g., the topcoat, rebar, concrete and other components used during construction) of the airport runway. For example, consider the set of temporally-spaced runway vibrations 802*a-c* shown in FIG. 8. These temporally-spaced runway vibrations 802*a-c* may be generated during after-touchdown braking of the landing aircraft, during and after landing rollout, etc.

Thus, in one embodiment, the set of temporally-spaced runway vibrations 802*a-c* were generated while a landing aircraft is applying its brakes after touchdown. The set of temporally-spaced runway vibrations 802*a-c* are temporally-spaced frequency (F) plus amplitude (A) vibration patterns that are received from uniquely-identified smart sensors coupled to the airport runway shown in FIG. 2.

In one embodiment, the temporally-spaced runway vibration 802*a* was generated as the landing aircraft brakes are first applied, the temporally-spaced runway vibration 802*b* was generated as application of the landing aircraft's brakes continue, and the temporally-spaced runway vibration 802*c* was generated at the conclusion of the landing aircraft's braking. This unique set of temporally-spaced runway vibrations is indicative of a particular condition of the construct of the airport runway. This unique condition may be a break in rebar, a chipping/sloughing of a topcoat to the airport runway, a chipping/calving of concrete chunks in the airport runway, etc. A trend analysis/comparison logic 804 (e.g., part of ARCEL 148 shown in FIG. 1) is able to analyze this set of temporally-spaced runway vibrations in order to create a runway analysis report 806, which describes the condition of the construct of the airport runway.

In one embodiment, the trend analysis/comparison logic 804 compares the newly generated set of temporally-spaced runway vibrations with a known set of temporally-spaced runway vibrations, which were previously generated during a set of known conditions (e.g., breakage, sloughing, chipping, etc.) to the airport runway (or a similarly constructed airport runway). Thus, if the two sets of temporally-spaced runway vibrations match, then the trend analysis/comparison logic 804 concludes that the condition that caused the known set of temporally-spaced runway vibrations now currently exists for the airport runway.

In one embodiment, the trend analysis/comparison logic 804 has a database of simulated temporally-spaced runway vibrations, which are used for comparison to the newly created set of temporally-spaced runway vibrations. As with the reality-based set of temporally-spaced runway vibrations, this leads to a determination of the real-time current state of the construct of the airport runway.

Figure 9:
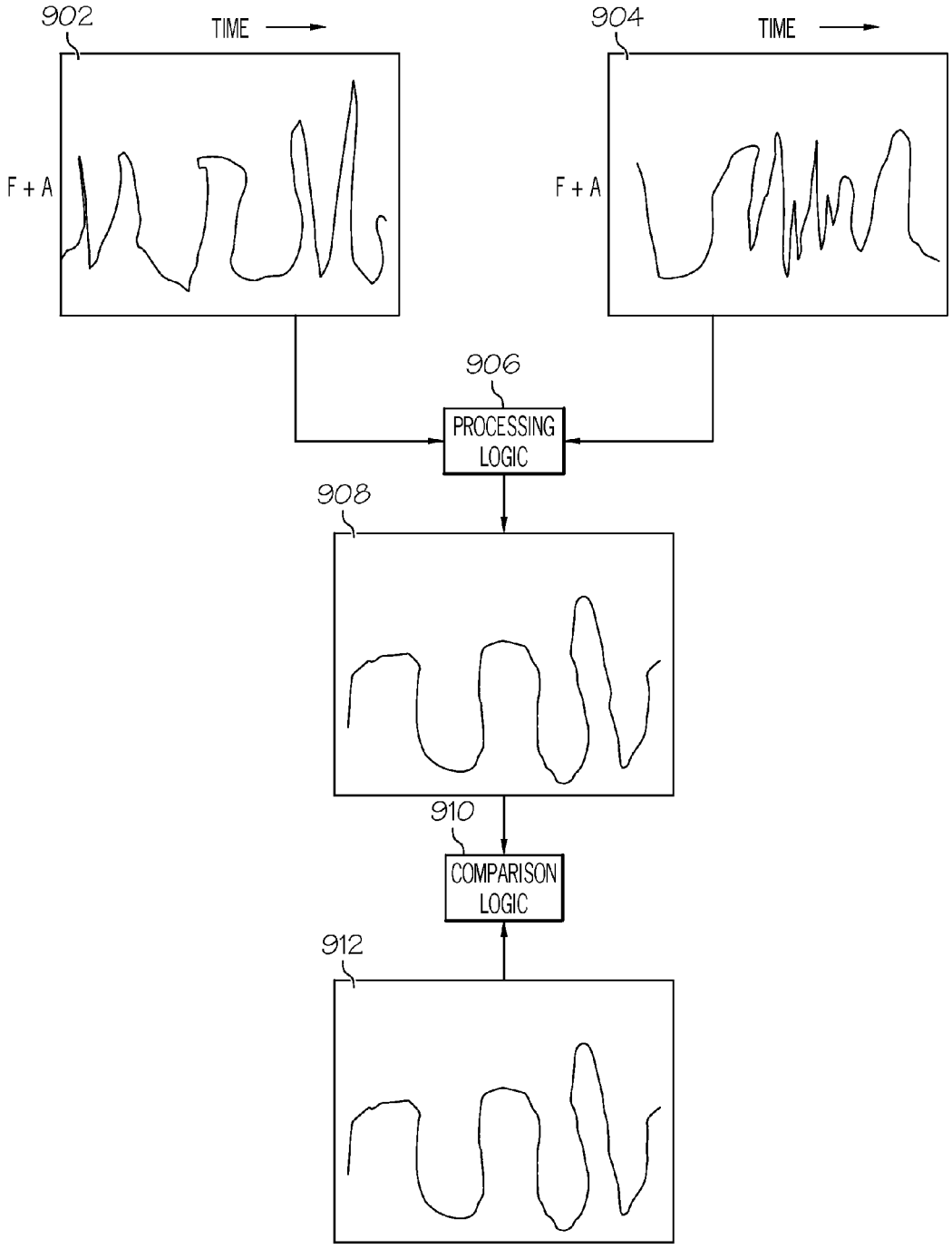
FIG. 9 illustrates airport runway patterns taken at impact when an aircraft touches down on the airport runway.

With reference now to block 712 of FIG. 7, in one embodiment a set of impact runway vibration readings is generated at a moment that the landing aircraft touches down on the airport runway. This set of impact runway vibration readings may be made by a single smart sensor on which the aircraft landed (e.g., smart sensor 304*b* shown in FIG. 3), or it may be from multiple sensors (e.g., smart sensors 304*a-e* shown in FIG. 3). If multiple sensors are used, then they are processed into a single waveform before being compared to historical waveforms. For example, as shown in FIG. 9, assume that smart sensor 304*b* and smart sensor 304*d* in FIG. 3 respectively generated the impact vibration patterns 902 and 904. A processing logic 906 (e.g., part of ARCEL 148 shown in FIG. 1) then combines these two patterns into a consolidated vibration pattern 908, which a comparison logic 910 then compares to a stored vibration pattern 912 in order to determine the impact level of the landing aircraft. In order to fully understand this impact level, in one embodiment the weight (obtained by the aircraft weight scale 206 shown in FIG. 2) and impact speed (based on the rate of descent as determined by the aircraft proximity sensor 208 depicted in FIG. 2) are also input into the analysis algorithm. Thus, a processor (e.g., processor unit 104 shown in FIG. 1) receives an impact vibration from the set of smart sensors; a landing weight of the landing aircraft from an aircraft weight scale on the airport runway; and a signal from an aircraft proximity sensor indicating a rate of descent of the landing aircraft upon touching down. The processor then uses the impact vibration, the landing weight, and the rate of descent as inputs to the analysis algorithm in order to determine an impact condition of the airport runway. In one embodiment, this analysis is used in a stand-alone manner to determine the condition of the construct of the airport runway. In another embodiment, the analysis is used to confirm the real-time physical condition of the airport runway that was generated from the braking vibration patterns described above.

With reference now to block 714 of FIG. 7, the impact runway vibration reading, plane weight, and/or plane rate of descent are input into the analysis algorithm in order to confirm the previously determined real-time physical condition of the construct of the airport runway, as described above.

As described in query block 716, a determination is then made as to whether data that describes the real-time physical condition of the construct of the airport runway falls outside a predetermined nominal range. For example, based on historical and/or simulation data, a level of deterioration of the airport runway is determined using the processes described herein. If this level of deterioration exceeds some predetermined level (e.g., there are too many potholes, the topcoat has deteriorated too much, the concrete is cracking too much), then corrective measures are initiated (block 718). Exemplary corrective measures include resurfacing the airport runway with a new topcoat; patching holes in the airport runway; replacing damaged sections of the airport runway; reducing aircraft traffic on that airport runway by moving future aircraft traffic to another runway; etc. Thus, these corrective measures return the real-time physical condition of the airport runway back within the predetermined nominal range. The process then ends at terminator block 720.

In one embodiment, the processor also evaluates the set of temporally-spaced runway vibrations in order to determine a braking distance for the landing aircraft after touching down on the airport runway. That is, by examining a set of temporally spaced vibration patterns, a processor can determine how long (in time and distance) a pilot of a landing aircraft had to apply the landing aircraft's brakes. This information is then used as an additional input to the analysis algorithm in order to confirm the real-time physical condition of the airport runway that was established in the process described in block 710.

In one embodiment, each of the smart sensors includes a uniquely-identified radio frequency identifier (RFID) tag (see FIG. 4 above). In this embodiment, a processor maps a physical location of each of the smart sensors by interrogating an RFID device in each smart sensor. The processor also receives a signal from an aircraft proximity sensor that indicates a runway location of the landing aircraft upon touching down. Using this additional information/data, the processor thus modifies the data that describes the set of temporally-spaced runway vibrations according to the runway location of the landing aircraft upon touching down relative to the location of each of the smart sensors. For example, assume that the set of temporally-spaced runway vibrations 802*a-c* are created when the landing aircraft touches down on top of smart sensor 304*b* shown in FIG. 3. However, if the landing aircraft touches down between smart sensor 304*b* and smart sensor 304*c*, then the set of temporally-spaced runway vibrations 802*a-c* will have a different appearance (i.e., will have a different set of underlying data components), even if all other conditions (aircraft weight, rate of descent, condition of the airport runway) are all the same as those conditions that existed when the set of temporally-spaced runway vibrations 802*a-c* were generated. In order to recognize that the two sets of temporally-spaced runway vibrations actually describe the same conditions, the processor thus modifies the data that describes the set of temporally-spaced runway vibrations according to the runway location of the landing aircraft upon touching down relative to the location of each of the smart sensors.

In one embodiment, the processor receives weather information describing current weather conditions on the airport runway, and then modifies the data that describes the set of temporally-spaced runway vibration patterns according to the weather conditions on the airport runway. Note that the present disclosure is not directed to simply determining if there is ice/snow/rain on the airport runway. However, these weather conditions will inherently affect the readings from the smart sensors, since they will result in different coefficients of friction between the landing aircraft's tires and the surface of the airport runway during landing/braking/rollout of the landing aircraft. As such, in this embodiment the real-time local weather conditions are used to adjust (e.g., filter out vibration patterns known to be caused by such local weather conditions) the set of temporally-spaced runway vibration patterns that were generated by the smart sensors.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Note further that any methods described in the present disclosure may be implemented through the use of a VHDL (VHSIC Hardware Description Language) program and a VHDL chip. VHDL is an exemplary design-entry language for Field Programmable Gate Arrays (FPGAs), Application Specific Integrated Circuits (ASICs), and other similar electronic devices. Thus, any software-implemented method described herein may be emulated by a hardware-based VHDL program, which is then applied to a VHDL chip, such as a FPGA.

Having thus described embodiments of the invention of the present application in detail and by reference to illustrative embodiments thereof, it will be apparent that modifications and variations are possible without departing from the scope of the invention defined in the appended claims.

What is claimed is:

1. A computer-implemented method of evaluating a real-time condition of a construct of an airport runway, the computer-implemented method comprising:

a processor receiving a set of temporally-spaced runway vibrations, wherein the set of temporally-spaced runway vibrations is measured by a set of smart sensors on an airport runway after a landing aircraft touches down on the airport runway; and the processor using data that describes the set of temporally-spaced runway vibrations as inputs to an analysis algorithm in order to determine a real-time physical condition of a construct of the airport runway.

2. The computer-implemented method of claim 1, further comprising:

the processor determining the real-time physical condition of the construct of the airport runway by comparing the set of temporally-spaced runway vibrations to a known series of temporally-spaced runway vibrations, wherein the known series of temporally-spaced runway vibrations was generated and recorded when the real-time physical condition of the construct of the airport runway previously existed at the airport runway.

3. The computer-implemented method of claim 1, further comprising:

the processor determining that data describing the real-time physical condition of the construct of the airport runway falls outside a predetermined nominal range; and the processor initiating corrective measures to return the real-time physical condition of the construct of the airport runway back within the predetermined nominal range.

4. The computer-implemented method of claim 1, further comprising:

the processor evaluating the set of temporally-spaced runway vibrations in order to determine a braking distance for the landing aircraft after touching down on the airport runway; and the processor using data that describes the braking distance as additional inputs to the analysis algorithm in order to confirm the real-time physical condition of the construct of the airport runway.

5. The computer-implemented method of claim 1, wherein each of the smart sensors comprises a uniquely-identified radio frequency identifier (RFID) tag, and wherein the computer-implemented method further comprises:

the processor mapping a location of each of the smart sensors by interrogating an RFID device in each smart sensor;

the processor receiving a signal from an aircraft proximity sensor indicating a runway location of the landing aircraft upon touching down; and the processor modifying the data that describes the set of temporally-spaced runway vibrations according to the runway location of the landing aircraft upon touching down relative to the location of each of the smart sensors.

6. The computer-implemented method of claim 1, further comprising:

the processor receiving an impact vibration from the set of smart sensors;

the processor receiving a landing weight of the landing aircraft from an aircraft weight scale on the airport runway;

the processor receiving a signal from an aircraft proximity sensor indicating a rate of descent of the landing aircraft upon touching down;

the processor using the impact vibration, the landing weight, and the rate of descent as inputs to the analysis algorithm in order to determine an impact condition of the airport runway; and the processor confirming the real-time physical condition of the construct of the airport runway based on the impact condition of the airport runway.

7. The computer-implemented method of claim 1, further comprising:

the processor receiving weather information describing current weather conditions on the airport runway; and the processor modifying the data that describes the set of temporally-spaced runway vibrations according to the weather conditions on the airport runway.

8. A computer program product for evaluating a real-time condition of a construct of an airport runway, the computer program product comprising:

a computer readable storage media;

first program instructions to receive a set of temporally-spaced runway vibrations, wherein the set of temporally-spaced runway vibrations is measured by a set of smart sensors on an airport runway as a landing aircraft applies its brakes after touching down on the airport runway; and second program instructions to input data that describes the set of temporally-spaced runway vibrations into an analysis algorithm in order to determine a real-time physical condition of a construct of the airport runway; and wherein the first and second program instructions are stored on the computer readable storage media.

9. The computer program product of claim 8, further comprising:

third program instructions to determine the real-time physical condition of the construct of the airport runway by comparing the set of temporally-spaced runway vibrations to a known series of temporally-spaced runway vibrations, wherein the known series of temporally-spaced runway vibrations was generated and recorded when the real-time physical condition of the construct of the airport runway previously existed at the airport runway; and wherein the third program instructions are stored on the computer readable storage media.

10. The computer program product of claim 8, further comprising:

third program instructions to determine that data describing the real-time physical condition of the construct of the airport runway falls outside a predetermined nominal range; and fourth program instructions to initiate corrective measures to return the real-time physical condition of the construct of the airport runway back within the predetermined nominal range; and wherein the third and fourth program instructions are stored on the computer readable storage media.

11. The computer program product of claim 8, further comprising:

third program instructions to evaluate the set of temporally-spaced runway vibrations in order to determine a braking distance for the landing aircraft after touching down on the airport runway; and fourth program instructions to input data that describes the braking distance as additional inputs to the analysis algorithm in order to confirm the real-time physical condition of the construct of the airport runway; and wherein the third and fourth program instructions are stored on the computer readable storage media.

12. The computer program product of claim 8, wherein each of the smart sensors comprises a uniquely-identified radio frequency identifier (RFID) tag, and wherein the computer program product further comprises:

third program instructions to map a location of each of the smart sensors by interrogating an RFID device in each smart sensor;

fourth program instructions to receive a signal from an aircraft proximity sensor indicating a runway location of the landing aircraft upon touching down; and fifth program instructions to modify the data that describes the set of temporally-spaced runway vibrations according to the runway location of the landing aircraft upon touching down relative to the location of each of the smart sensors; and wherein the third, fourth, and fifth program instructions are stored on the computer readable storage media.

13. The computer program product of claim 8, further comprising:

third program instructions to receive an impact vibration from the set of smart sensors;

fourth program instructions to receive a landing weight of the landing aircraft from an aircraft weight scale on the airport runway;

fifth program instructions to receive a signal from an aircraft proximity sensor indicating a rate of descent of the landing aircraft upon touching down;

sixth program instructions to in the impact vibration, the landing weight, and the rate of descent into the analysis algorithm in order to determine an impact condition of the airport runway; and seventh program instructions to confirm the real-time physical condition of the construct of the airport runway based on the impact condition of the airport runway; and wherein the third, fourth, fifth, sixth, and seventh program instructions are stored on the computer readable storage media.

14. The computer program product of claim 8, further comprising:

third program instructions to receive weather information describing current weather conditions on the airport runway; and fourth program instructions to modify the data that describes the set of temporally-spaced runway vibrations according to the weather conditions on the airport runway; and wherein the third and fourth program instructions are stored on the computer readable storage media.

15. A system comprising:

a processor, a computer readable memory, and a computer readable storage media;

first program instructions to receive a set of temporally-spaced runway vibrations, wherein the set of temporally-spaced runway vibrations is measured by a set of smart sensors on an airport runway as a landing aircraft applies its brakes after touching down on the airport runway; and second program instructions to input data that describes the set of temporally-spaced runway vibrations into an analysis algorithm in order to determine a real-time physical condition of a construct of the airport runway; and wherein the first and second program instructions are stored on the computer readable storage media for execution by the processor via the computer readable memory.

16. The system of claim 15, further comprising:

third program instructions to determine the real-time physical condition of the construct of the airport runway by comparing the set of temporally-spaced runway vibrations to a known series of temporally-spaced runway vibrations, wherein the known series of temporally-spaced runway vibrations was generated and recorded when the real-time physical condition of the construct of the airport runway previously existed at the airport runway; and wherein the third program instructions are stored on the computer readable storage media for execution by the processor via the computer readable memory.

17. The system of claim 15, further comprising:

third program instructions to determine that data describing the real-time physical condition of the construct of the airport runway falls outside a predetermined nominal range; and fourth program instructions to initiate corrective measures to return the real-time physical condition of the construct of the airport runway back within the predetermined nominal range; and wherein the third and fourth program instructions are stored on the computer readable storage media for execution by the processor via the computer readable memory.

18. The system of claim 15, further comprising:

third program instructions to evaluate the set of temporally-spaced runway vibrations in order to determine a braking distance for the landing aircraft after touching down on the airport runway; and fourth program instructions to input data that describes the braking distance as additional inputs to the analysis algorithm in order to confirm the real-time physical condition of the construct of the airport runway; and wherein the third and fourth program instructions are stored on the computer readable storage media for execution by the processor via the computer readable memory.

19. The system of claim 15, wherein each of the smart sensors comprises a uniquely-identified radio frequency identifier (RFID) tag, and wherein the system further comprises:

third program instructions to map a location of each of the smart sensors by interrogating an RFID device in each smart sensor;

fourth program instructions to receive a signal from an aircraft proximity sensor indicating a runway location of the landing aircraft upon touching down; and fifth program instructions to modify the data that describes the set of temporally-spaced runway vibrations according to the runway location of the landing aircraft upon touching down relative to the location of each of the smart sensors; and wherein the third, fourth, and fifth program instructions are stored on the computer readable storage media for execution by the processor via the computer readable memory.

20. The system of claim 15, further comprising:

third program instructions to receive an impact vibration from the set of smart sensors;

fourth program instructions to receive a landing weight of the landing aircraft from an aircraft weight scale on the airport runway;

fifth program instructions to receive a signal from an aircraft proximity sensor indicating a rate of descent of the landing aircraft upon touching down;

sixth program instructions to in the impact vibration, the landing weight, and the rate of descent into the analysis algorithm in order to determine an impact condition of the airport runway; and seventh program instructions to confirm the real-time physical condition of the construct of the airport runway based on the impact condition of the airport runway; and wherein the third, fourth, fifth, sixth, and seventh program instructions are stored on the computer readable storage media for execution by the processor via the computer readable memory.

* * * * *